US007594695B2

(12) United States Patent
Noonan

(10) Patent No.: US 7,594,695 B2
(45) Date of Patent: Sep. 29, 2009

(54) APPARATUS AND METHODS FOR COVERING OUTDOOR PATIO FURNITURE

(76) Inventor: Mark Noonan, 55 St. John Pl., Suite 201, New Canaan, CT (US) 06840

( * ) Notice: Subject to any disclaimer, the term of this patent is extended or adjusted under 35 U.S.C. 154(b) by 155 days.

(21) Appl. No.: 11/861,061

(22) Filed: Sep. 25, 2007

(65) Prior Publication Data

US 2008/0284217 A1 Nov. 20, 2008

Related U.S. Application Data

(60) Provisional application No. 60/938,378, filed on May 16, 2007.

(51) Int. Cl.
*A47C 7/66* (2006.01)

(52) U.S. Cl. ..... 297/184.11; 150/158

(58) Field of Classification Search ..... 297/172, 297/184.11, 188.2, 310, 423.4; 160/24, 370.22; 296/37.16, 63, 97.8, 152; 150/158
See application file for complete search history.

(56) References Cited

U.S. PATENT DOCUMENTS 1,079,606 A * 11/1913 Rooney ..... 297/188.09
2,261,443 A 11/1941 McGaw
2,514,438 A 7/1950 Bardega
2,605,823 A 8/1952 Lockhart
2,804,914 A * 9/1957 Butcko et al. ..... 297/229
4,118,066 A * 10/1978 Ricke ..... 297/184.11
4,600,238 A * 7/1986 Goodford ..... 297/219.1
4,702,297 A 10/1987 Van Klompenburg
4,790,592 A * 12/1988 Busso et al. ..... 297/184.11
5,330,251 A * 7/1994 McGuire ..... 297/229
5,606,918 A * 3/1997 Cauffiel ..... 108/42
6,158,805 A * 12/2000 Blaney ..... 297/184.11
6,167,936 B1 1/2001 Stover et al.
6,637,815 B1 * 10/2003 Louque et al. ..... 297/184.11
6,655,736 B1 * 12/2003 Arenas ..... 297/229

* cited by examiner

*Primary Examiner*—Peter R. Brown
(74) *Attorney, Agent, or Firm*—Harness, Dickey & Pierce, P.L.C.

(57) ABSTRACT

In one exemplary embodiment, an apparatus for covering a piece of furniture generally includes a base, a spool rotatably supported by the base, and a cover coupled to the spool. The apparatus may also include an attachment device for removably attaching a portion of the cover to the furniture piece for helping retain the cover's position relative to the furniture piece. The spool may be rotatable in a first rotational direction relative to the spool mount for winding the cover onto the spool. The spool may also be rotatable in a second rotational direction opposite that of the first rotational direction for unwinding the cover from the spool, to thereby allow the unwound cover to be placed generally over the furniture piece.

16 Claims, 6 Drawing Sheets

APPARATUS AND METHODS FOR COVERING OUTDOOR PATIO FURNITURE

CROSS-REFERENCE TO RELATED APPLICATION

This application claims the benefit of U.S. Provisional Application No. 60/938,378 filed May 16, 2007. The disclosure of the above application is incorporated herein by reference.

FIELD

The present disclosure generally relates to apparatus and methods for covering outdoor patio furniture.

BACKGROUND

Outdoor patio furniture is regularly used in backyards, on decks, and patios. Because this furniture must withstand harsh weather conditions (e.g., excessive rain or sunlight, etc.), plastic materials are commonly used to form the furniture. Unfortunately, plastic furniture is normally not very comfortable to the user. Accordingly, padding and cushions are commonly provided to make the furniture more comfortable. But this padding and cushion may be susceptible to damage and saturation from rain and other weather conditions such that special measures must be taken in order to keep the padding and cushions dry for use.

SUMMARY

According to exemplary aspects of the present disclosure, exemplary embodiments are disclosed of apparatus for covering furniture. In one exemplary embodiment, an apparatus for covering a piece of furniture generally includes a base, a spool rotatably supported by the base, and a cover coupled to the spool. The apparatus may also include an attachment device for removably attaching a portion of the cover to the furniture piece for helping retain the cover's position relative to the furniture piece. The spool may be rotatable in a first rotational direction relative to the spool mount for winding the cover onto the spool. The spool may also be rotatable in a second rotational direction opposite that of the first rotational direction for unwinding the cover from the spool, to thereby allow the unwound cover to be placed generally over the furniture piece.

In another exemplary embodiment, an apparatus for covering a piece of furniture generally includes a spool mount, a spool rotatably supported by the spool mount, and a cover coupled to the spool. The apparatus may also include a retention device for retaining the position of the apparatus relative to the furniture piece. The spool may be rotatable in a first rotational direction relative to the spool mount for winding the cover onto the spool. The spool may be rotatable in a second rotational direction opposite that of the first rotational direction for unwinding the cover from the spool to thereby allow the unwound cover to be placed generally over the furniture piece.

Other exemplary aspects of the present disclosure include methods relating to covering a piece of furniture. In one exemplary embodiment, a method generally includes unrolling a cover from a spool rotatably supported by a base. The method may also include positioning the unrolled cover generally over the piece of furniture. The method may further include removably attaching at least a portion of the cover to the furniture piece to thereby help retain the cover's position relative to the furniture piece.

Further aspects and features of the present disclosure will become apparent from the detailed description provided hereinafter. It should be understood that the detailed description and specific examples, while indicating exemplary embodiments of the present disclosure, are intended for purposes of illustration only and are not intended to limit the scope of the present disclosure.

BRIEF DESCRIPTION OF THE DRAWINGS

The present disclosure will become more fully understood from the detailed description and the accompanying drawings, wherein.

DETAILED DESCRIPTION OF EXEMPLARY EMBODIMENTS

Figure 1:
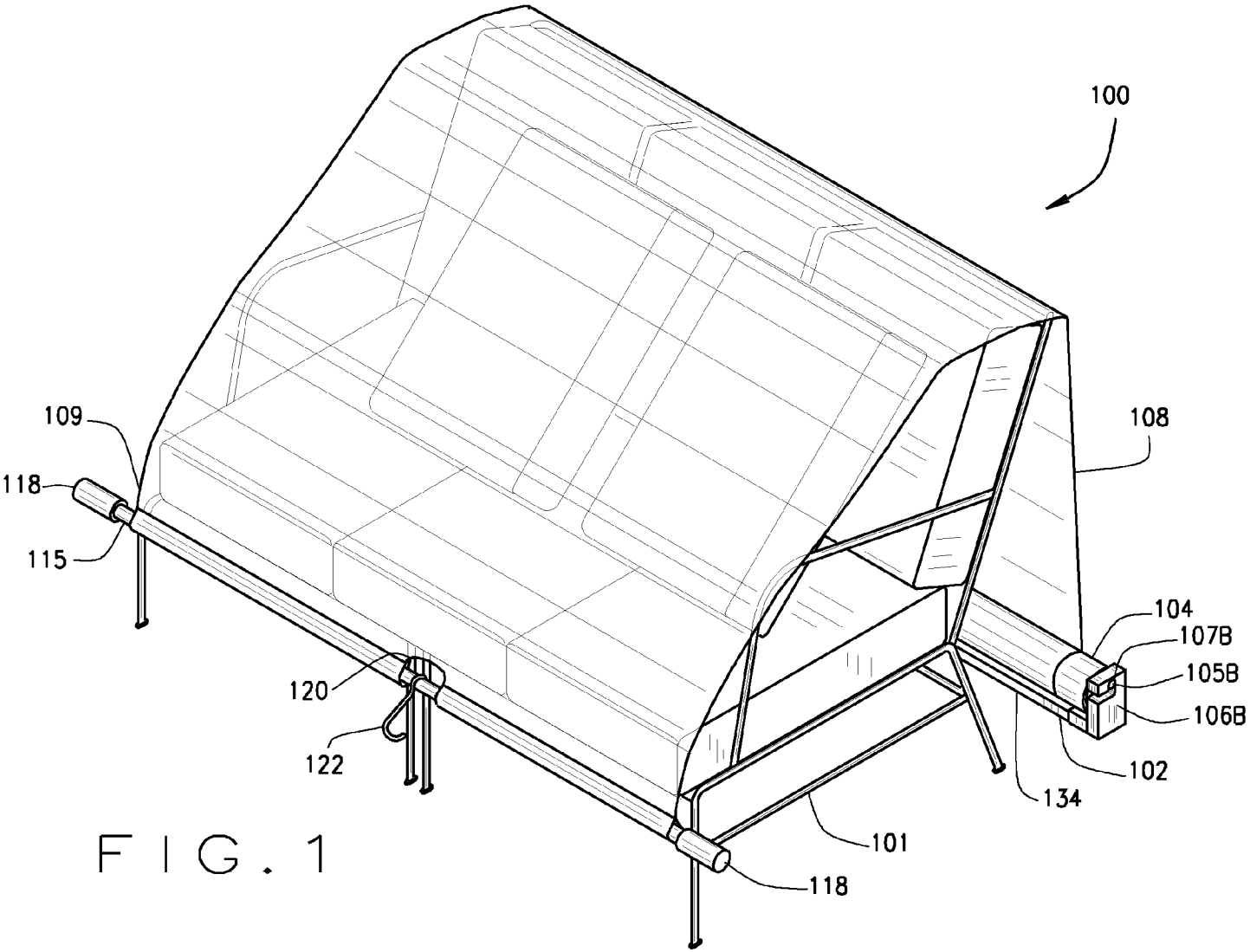
FIG. 1 is a perspective view of a furniture covering device according to one exemplary embodiment being used in conjunction with an exemplary piece of outdoor furniture.

The following description of various embodiments is merely exemplary in nature and is in no way intended to limit the present disclosure, its applications, or uses.

According to exemplary aspects of the present disclosure, exemplary embodiments are disclosed of apparatus for covering furniture. In one exemplary embodiment, an apparatus for covering a piece of furniture generally includes a base, a spool rotatably supported by the base, and a cover coupled to the spool. The apparatus may also include an attachment device for removably attaching a portion of the cover to the furniture piece for helping retain the cover's position relative to the furniture piece. The spool may be rotatable in a first rotational direction relative to the spool mount for winding or rolling the cover onto the spool. The spool may also be rotatable in a second rotational direction opposite that of the first rotational direction for unwinding or unrolling the cover from the spool, to thereby allow the unwound cover to be placed generally over the furniture piece.

In another exemplary embodiment, an apparatus for covering a piece of furniture generally includes a spool mount, a spool rotatably supported by the spool mount, and a cover coupled to the spool. The apparatus may also include a retention device for retaining the position of the apparatus relative to the furniture piece. The spool may be rotatable in a first rotational direction relative to the spool mount for winding or rolling the cover onto the spool. The spool may be rotatable in a second rotational direction opposite that of the first rotational direction for unwinding or unrolling the cover from the spool to thereby allow the unwound cover to be placed generally over the furniture piece.

In various embodiments, at least one foot pad may be coupled to the base for positioning between a support member (e.g., leg, etc.) of the furniture piece and a support surface to thereby retain the base's position relative to the furniture piece. For example, the foot pads may be positioned under a chair's feet. This may advantageously help keep the base from being lifted or moved as the cover is being pulled and unwound from the spool. This may also help keep the base from being lifted off the support surface (e.g., ground, outdoor patio deck, etc.) or pulled out of place by wind.

Other exemplary aspects of the present disclosure include methods relating to covering a piece of furniture. In one exemplary embodiment, a method generally includes unrolling a cover from a spool rotatably supported by a base. The method may also include positioning the unrolled cover generally over the piece of furniture. The method may further include removably attaching at least a portion of the cover to the furniture piece to thereby help retain the cover's position relative to the furniture piece. In some embodiments, uncovering the furniture by rolling the cover back onto the spool and storing the cover within an enclosure cooperatively defined by a housing member and a base in some embodiments. The method may also include positioning at least foot pad (coupled to a base) between a support member (e.g., leg, foot, etc.) of the furniture piece and a support surface.

The various aspects of the present disclosure may be used individually or in combination with any one or more of the other aspects of the present disclosure.

Figure 2:
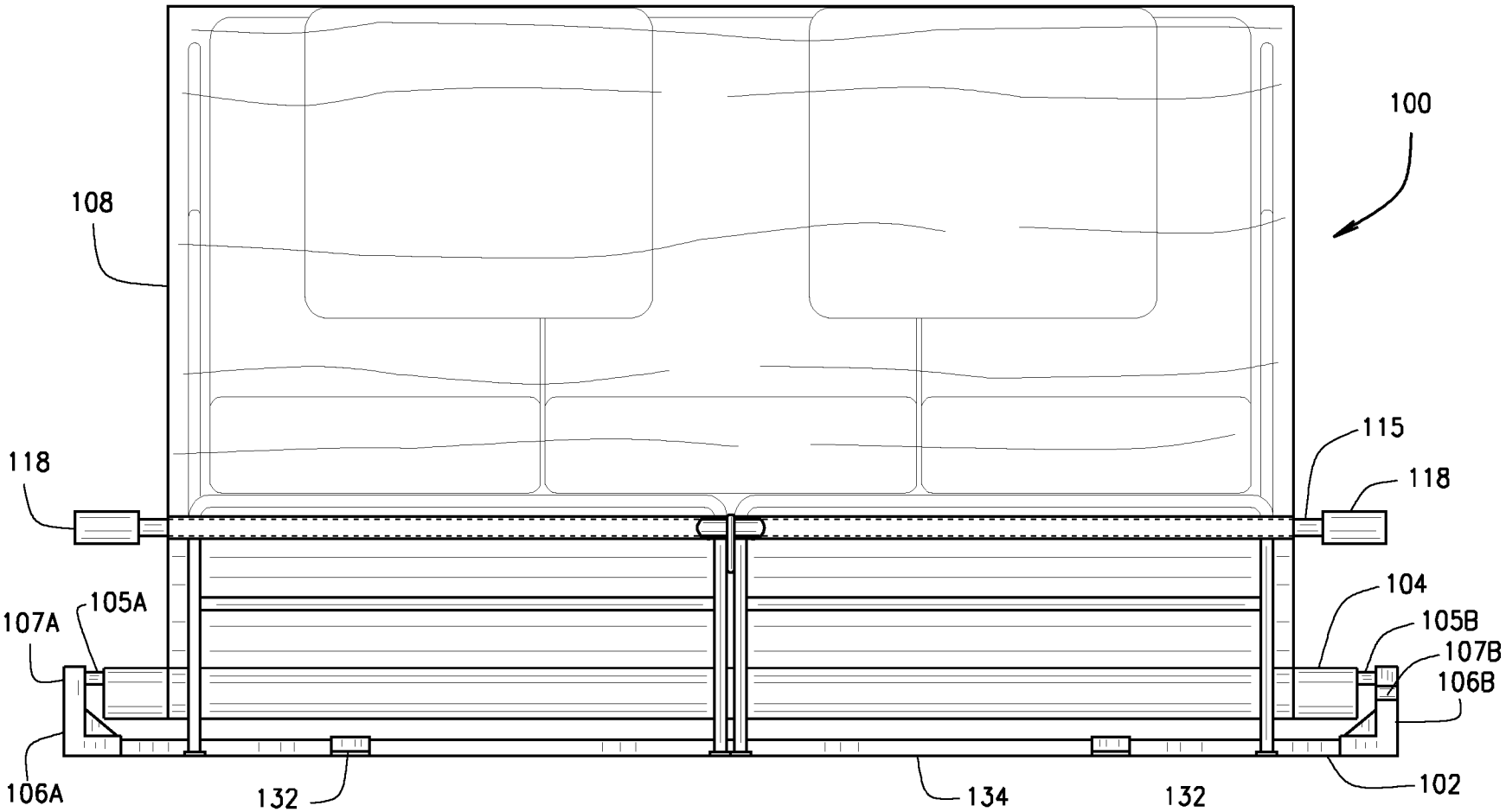
FIG. 2 is a front view of the furniture covering device shown in FIG. 1.
Figure 3:
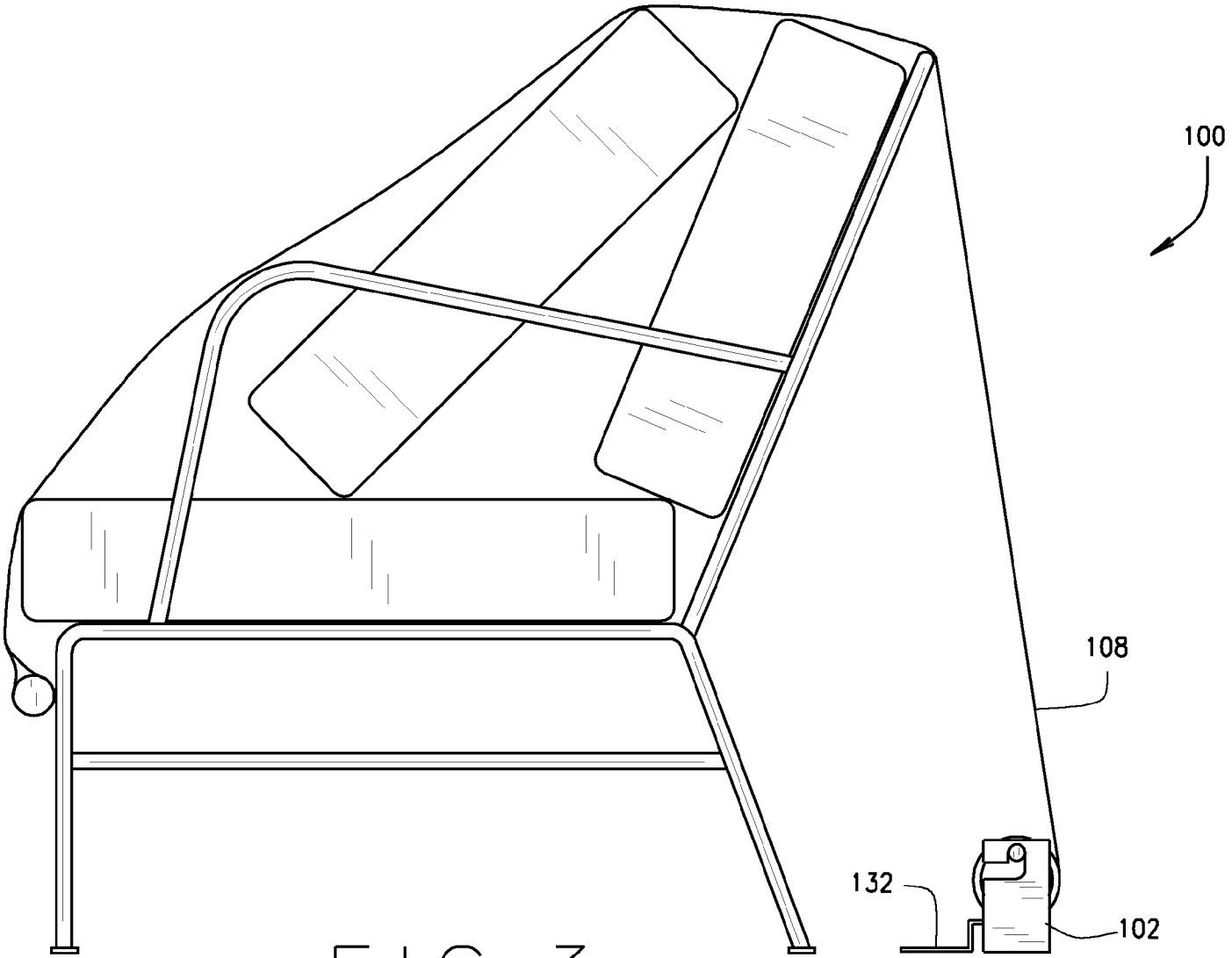
FIG. 3 is another view of the furniture covering device shown in FIG. 1.

FIGS. 1 through 3 illustrate a furniture covering apparatus 100 according to one exemplary embodiment being used for substantially covering a furniture piece 101. As used herein, the term "furniture" shall include a wide range of furniture whether that furniture is intended for indoor use or outdoor use. Exemplary furniture pieces include chairs, tables, recliners, couches, dressers, among others. Accordingly, the specific references to outdoor patio furniture should not be construed as limiting the scope of the present disclosure to any specific form/type of furniture.

With continued reference to FIGS. 1 through 3, the apparatus 100 includes a base, support, or spool mount 102. The apparatus 100 also includes a spool 104 of covering material 108. The spool 104 is rotatably coupled to the base 102 such that the cover 108 may be wound onto and unwound from the spool 104.

In this particular embodiment, the spool's end portions 105A and 105B are respectively received within corresponding first and second openings 107A, 107B of the base's end portions 106A, 106B, to thereby rotatably support the spool 104 by the base 102. As shown in FIG. 2, the spool's end portion 105A is disposed within a thru-hole 107A (e.g., circular hole, etc.) of the base's end portion 106A. As shown in FIG. 1, the spool's other end portion 105B is disposed within a generally L-shaped slot 107B of the base's end portion 106B. The L-shaped slot 107B includes a lower generally horizontal portion with an open end, and an upper generally vertical portion with a closed end. Accordingly, the spool 104 may be added to the base 102 by positioning the spool's end portion 105A into the thru-hole 107A, and then sliding the spool's other end portion 105B into the L-shaped slot 107B via the open end of the L-shaped slot's lower generally horizontal portion. At which point, the thru-hole 107A and closed end of the L-shaped slot's upper generally vertical portion cooperatively retain the spool 104 from dislodging from the base 102, such as when the cover 108 is being unwound from the spool 104. This particular mounting arrangement of the spool 104 to the base 102 may also allow for ready removal and replacement of the spool 104, such as when an existing spool or the covering material wound thereon is worn out, and/or when a different color of covering material is desired. Alternative methods may also be employed for rotatably supporting the spool from the base 102, including differently configured openings in other shapes (e.g., T-shaped, etc.), sizes, locations, etc. In another exemplary embodiment, a spool may be rotatably supported by brackets that are integral to a base or attached to a base, for example, by screws or other suitable fasteners (e.g., nails, adhesives, etc.). In yet another exemplary embodiment, a spool may be rotatably supported by positioning the spool's end portions into respective L-shaped slots of the base. A further embodiment may include the spool's end portions being positioned within respective generally C-shaped or U-shaped openings of a base (e.g., horizontally opening C-shape, upwardly opening U-shape, etc.). In embodiments in which a spool's end portions are positioned within respective generally upwardly opening U-shaped openings of a base, one or more other components (e.g., housing member 410 (FIG. 6), etc.) may be disposed adjacent or within the top portion of the U-shaped openings to help ensure that the spool resists being pulled loose or dislodging from the base.

Figure 6:
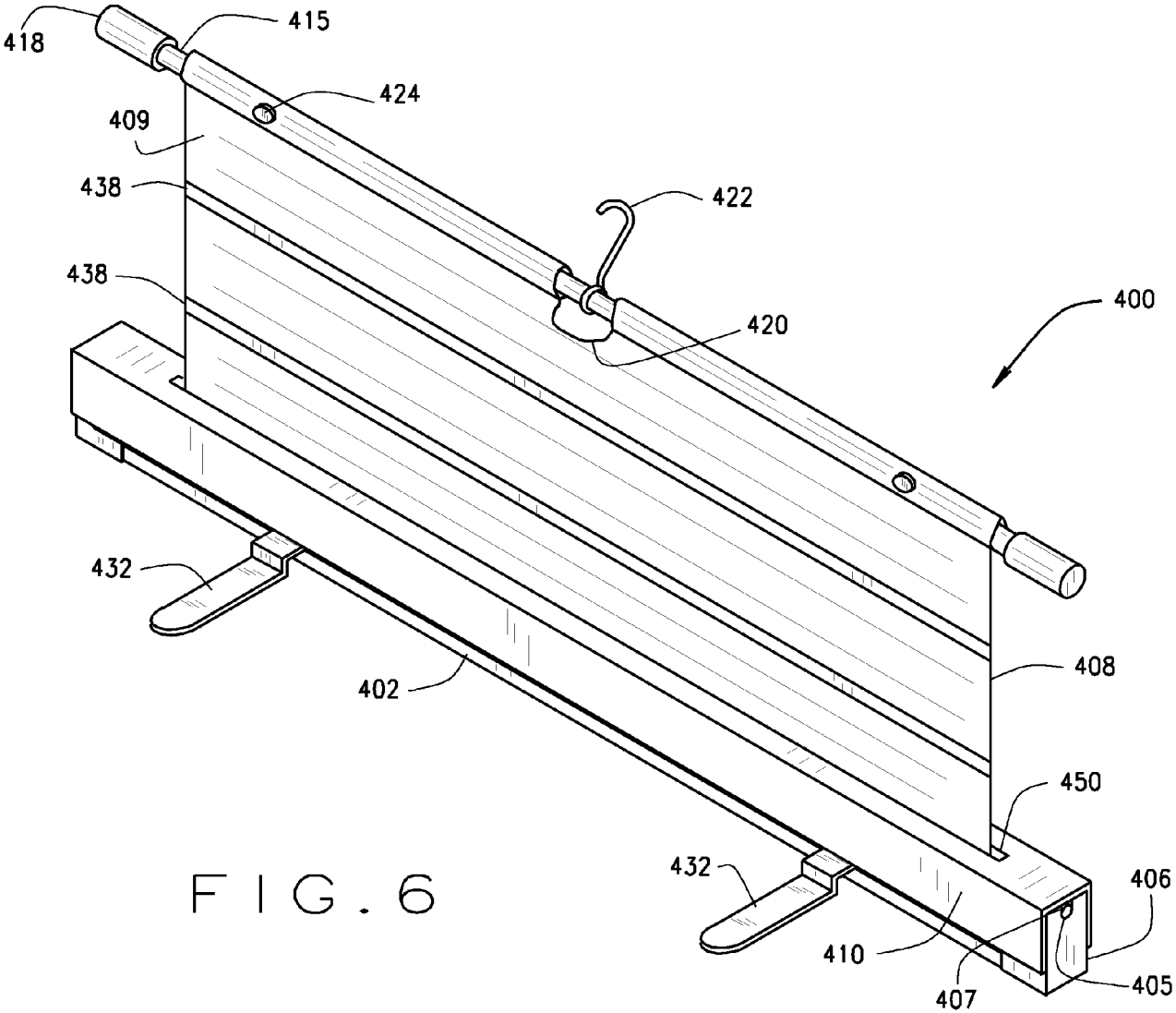
FIG. 6 is a perspective view of another furniture covering device according to another exemplary embodiment.

Accordingly, the cover 108 may be wound back onto the spool 104 when the cover 108 is not being used. In various embodiments, the apparatus 100 may also include a housing member (e.g., housing member 410 in FIG. 6, etc.) configured to be positioned generally over the spool 104 and coupled to the base 102. In such exemplary embodiments, the spool 104 may thus be stored and housed within the space cooperatively defined by the housing member and the base 102. For example, and as described below, FIG. 6 illustrate another exemplary embodiment of a furniture covering device 400 in which a spool may be housed or stored within the enclosed area cooperatively defined by the housing member 410 and the base 402.

With continued reference to FIGS. 1 through 3, a wide range of materials may be used for the cover 108. In exemplary embodiments, the cover 108 may be formed from plastic materials (e.g., rollable plastic sheet material, etc.), transparent materials, (e.g., cover 108 is transparent in FIGS. 1 through 3, etc.), translucent materials, opaque materials, colored materials, waterproof materials, ultraviolet-resistant materials, mildew-resistant materials, nylon fabrics, UV-protected rip stop nylons, vinyl materials (e.g., vinyl flat cover material, etc.), combinations thereof, etc.

The cover 108 may be provided in one or more various colors. The cover 108 may be opaque, translucent, transparent, reflective, combinations thereof, etc. In various embodiments, the cover 108 may be provided in a color that substantially matches the color of the furniture piece (e.g., color of the padded cushions thereof) being covered. In other embodiments, the cover 108 may be provided in a color that substantially matches the color of the deck surface supporting the furniture piece. In one exemplary embodiment, the cover 108 is at least substantially transparent in order to provide a favorable aesthetic appearance from a distance because at a distance the cover 108 will be substantially unnoticeable or invisible. Alternatively, other suitable materials having one or more of the above properties may also be used.

The cover 108 may have one end portion attached to the spool 104, which, in turn, may comprise a tubular member or rod. In various embodiments, the spool 104 comprises a plastic rod or tube about which the cover 108 may be wound or spooled. Alternatively, other sufficiently stiff materials and/or other various shapes (e.g., cylindrical shapes, flat bars, rectangular, triangular, etc.) may be used for the spool 104.

As further described below, the other end portion or free end portion 109 of the cover 108 may include or be provided with at least one attachment device (e.g., one or more magnets, hooks, Velcro, etc.) for removably attaching the free end portion 109 of the cover 108 to the furniture piece 101 to thereby help retain the cover's positioning relative to the furniture piece 101. This may be especially important, for example, during high winds to help keep the cover 108 from retracting or blowing off the furniture piece 101.

In the illustrated embodiment of FIGS. 1 through 3, a rod 115 of sufficiently stiff material (e.g., plastic, metal, etc.) is attached to the free end portion 109 of the cover 108. By way of example only the rod 115 may be disposed within a pocket or sleeve defined by folding and stitching along the free end portion 109 of the cover 108. Alternatively, other suitably heavy objects in other shapes may be attached via other suitable ways to the free end portion 109 of the cover 108 to help retain the relative positioning of the cover 108 over the furniture piece 101.

The ends of the rod 115 may extend outwardly beyond the cover 108 so as to create handles for the user to grasp and thereby facilitate unwinding the cover 108 from the spool 104. By way of example only, various exemplary embodiments have the ends of the rod 115 extending outwardly beyond the sides of the cover 108 by about three inches in one embodiment, about six inches in another embodiment, and between about three inches to about six inches in yet another embodiment. In these embodiments, the rod's end portions may thus provide handles for the user to grasp and thereby facilitate unwinding the cover 108 from the spool 104. A relatively soft material (e.g., foam, etc.) may be disposed over the handle portions for user comfort. For example, FIGS. 1 through 3 illustrate end caps 118 disposed at the end portions of the rod 115. In addition to providing user comfort, the end caps 118 may also help to conceal the rod 115 within the cover 108 for aesthetic purposes. In embodiments in which the rod 115 is tubular or hollow, the end caps 118 may also help keep water from getting into the hollow interior of the rod 115. Other embodiments may include a solid rod and optional end caps for use comfort and/or aesthetic purposes.

With continued reference to FIGS. 1 and 3, the illustrated cover 108 may also include a cutout or removed portion 120. This cutout portion 120 may be configured to help a user to unwind the cover 108 from the spool 104, for example, when using only one hand.

A hook 122 (or other suitable device) may also be attached to the cover 108. The hook 122 may also help a user to unwind the cover 108 from the spool 104, for example, when using only one hand. The hook 122 may also be used for helping removably attach the free end portion 109 of the cover 108 to the furniture piece 101 to thereby help retain the cover's positioning relative to the furniture piece 101. For example, after unwinding the cover 108 and extending it over the furniture piece 101, the hook 122 may then be hooked onto a portion (e.g., frame, etc.) of the furniture piece 101.

The cover 108 may also include one or more magnets (e.g., magnets 424 in FIG. 6, etc.) for removably attaching the free end portion 109 of the cover 108 to the furniture piece 101. In such embodiments, the cover 108 may thus be magnetically attached, for example, to furniture piece having a frame made of steel, wrought iron, other magnetically responsive material (e.g., iron, etc.), and/or permanent magnetic material (e.g., neodymium-iron-boron (Nd—Fe—B), etc.), etc.

In some embodiments, the apparatus 100 may include one or more biasing devices (e.g., coil spring, etc.) to provide a biasing force for causing the spool 104 to rotate in the direction (e.g., clockwise in FIG. 3, etc.) for winding the cover 108 onto the spool 104. Other suitable biasing devices may also be employed in other embodiments. In some embodiments, there may be provided the ability to adjust the tension of the spring recoil action. Other embodiments may include a spring biasing device without any device though for specifically adjusting the tension of the spring recoil action. Still further embodiments do not include any spring biasing device.

As shown in FIG. 3, the cover 108 may be preferably sized so as to extend completely over and beyond the lateral side edges of the furniture piece. When positioned over the furniture piece, the cover 108 would thus overhang the furniture. Accordingly, the cover 108 may help prevent (or at least reduce the extent of) the furniture (and its cushions and/or padding) from getting wet. For example, positioning the exemplary cover 108 over a piece of furniture should help prevent (or at least inhibit) the entire furniture piece from getting soaked or saturated. Even if the ends of the furniture piece may get a little wet, the cover 108 may also help prevent (or at least inhibit) the cushions of a furniture piece from getting wet, if at all, as well prevent (or at least inhibit) water from soaking deeply into or saturating the cushions. Even when it is raining during very high winds, the cover 108 may provide at least some protection (or at least reduce the amount of) rain to which the cushions would otherwise be exposed. As shown in the figures, the illustrated cover 108 is functionally designed and intended to cover a three-dimensional object, like furniture.

The base 102 may be configured (e.g., sized, made of sufficiently heavy materials, etc.) such that the apparatus 100 is sufficiently heavy enough to retain its position relative to the furniture piece, for example, during relatively high winds. Alternatively, other systems and methods may be used to help retain the relative positioning of the apparatus 100 to the furniture piece 101. For example, FIG. 3 illustrates foot pads 132, which may be slidably positioned underneath the corresponding feet of the furniture piece. Other embodiments may include differently configured foot pads, adhesives, mechanical fasteners, hook and loop fasteners, magnets, combinations thereof, etc. For example, one embodiment may include a base, support, or spool mount having one or more magnets for magnetic attachment to a magnetically responsive portion of a furniture piece (e.g., chair leg, under a table, etc.) formed of a magnetically responsive material, such as a magnetically permeable material (e.g., iron, etc.) and/or permanent magnetic material (e.g., neodymium-iron-boron (Nd—Fe—B), etc.).

The base 102 may be formed from a wide range of materials. In one exemplary embodiment, the base 102 is formed from wood. In another embodiment, the base 102 may be formed from a moldable plastic material or materials, such as materials that do not rust or are treated to be rust proof (e.g., non-rusting metals or coated metals, etc.). In some embodiments, the base 102 may be formed from a sufficiently heavy enough material such that the weight of the base 102 alone is heavy enough to retain its position without any positioning of foot pads 132 (e.g., FIG. 3, etc.) under the furniture support member. Accordingly, some embodiments do not include any such foot pads.

In FIGS. 1 through 3, the end portions 106 are illustrated as separate components that may be coupled to a middle base portion 134. In other exemplary embodiments, the end portions 106 and middle base portion 134 may be molded from plastic or other material such that the middle base portions 134 and end portions 106 have an integral or single monolithic component construction. Alternatively, other methods may be employed for integrally forming the end portions 106 with the middle base portion 134, such that the end portions 106 would not be separately coupled to the medial base portion 134. In yet other embodiments, the middle base portion 134 may be formed (e.g., molded, etc.) so as to have a solid interior (e.g., middle base portion 334 shown in FIG. 5, etc.). As a further example, the middle base portion 134 may be formed (e.g., extruded, etc.) so as to be tubular and have a hollow interior, for example, to decrease the weight and material needed for the middle base portion 134.

Figure 4:
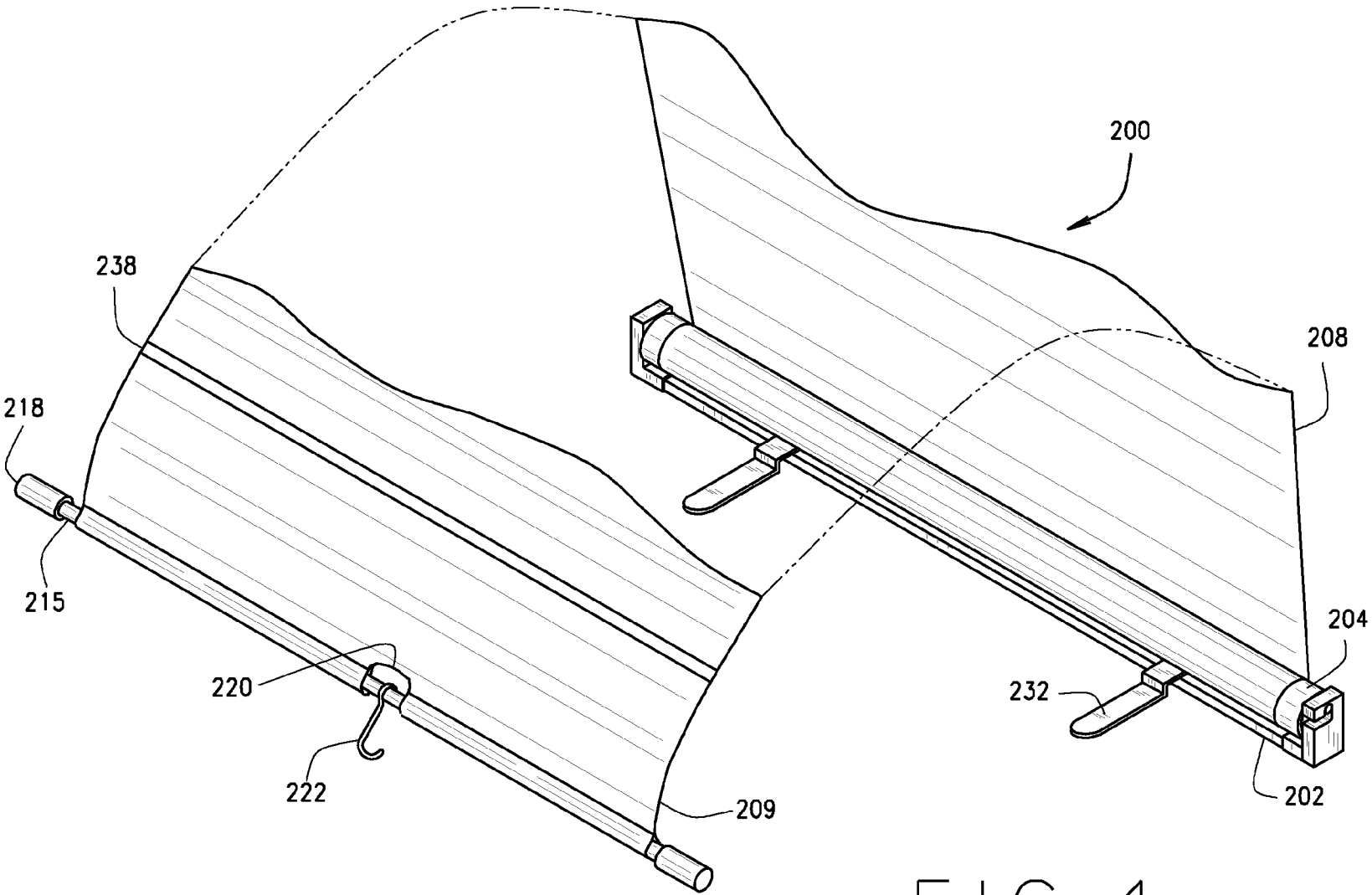
FIG. 4 is a perspective view of a furniture covering device according to another exemplary embodiment.

FIG. 4 illustrates another exemplary embodiment of a furniture covering apparatus 200. As shown, the apparatus 200 includes a base, support, or spool mount 202. The apparatus 100 also includes a spool 204 of covering material 208. The apparatus 200 further includes foot pads 232, a rod 215 at the cover's free end portion 209, end caps 218, a cutout or removed portion 220, and a hook 222. Accordingly, this embodiment of the apparatus 200 and some of its components may be generally similar to the apparatus 100 and the corresponding components thereof previously described and illustrated in FIGS. 1 through 3.

As shown in FIG. 4, the apparatus 200 further includes stays, ribbing, or batons 238 that are configured to help keep the cover 208 remain laterally extended or "tented" generally over the edges of the furniture piece. This "tenting" feature provided by the stays, ribbing, or batons 238 may help improve the ability of the cover 208 to deflect and divert rain off the cover 208. This "tenting" feature may also help inhibit the cover 208 from being blown backwardly along the cover's edges, which might otherwise allow rain to ingress along the edges of the cover 208.

A wide range of materials (e.g., fiberglass, plastic, etc.) may be used to provide the cover 208 with one or more stays, ribs, or batons 238. Plus, various methods may be used to provide or attach the stays, ribs, or batons 238 to the cover 208, such as adhesive bonding, via a sewn or stitched pocket or slot into which is slidably received a stay member, etc.

Figure 5:
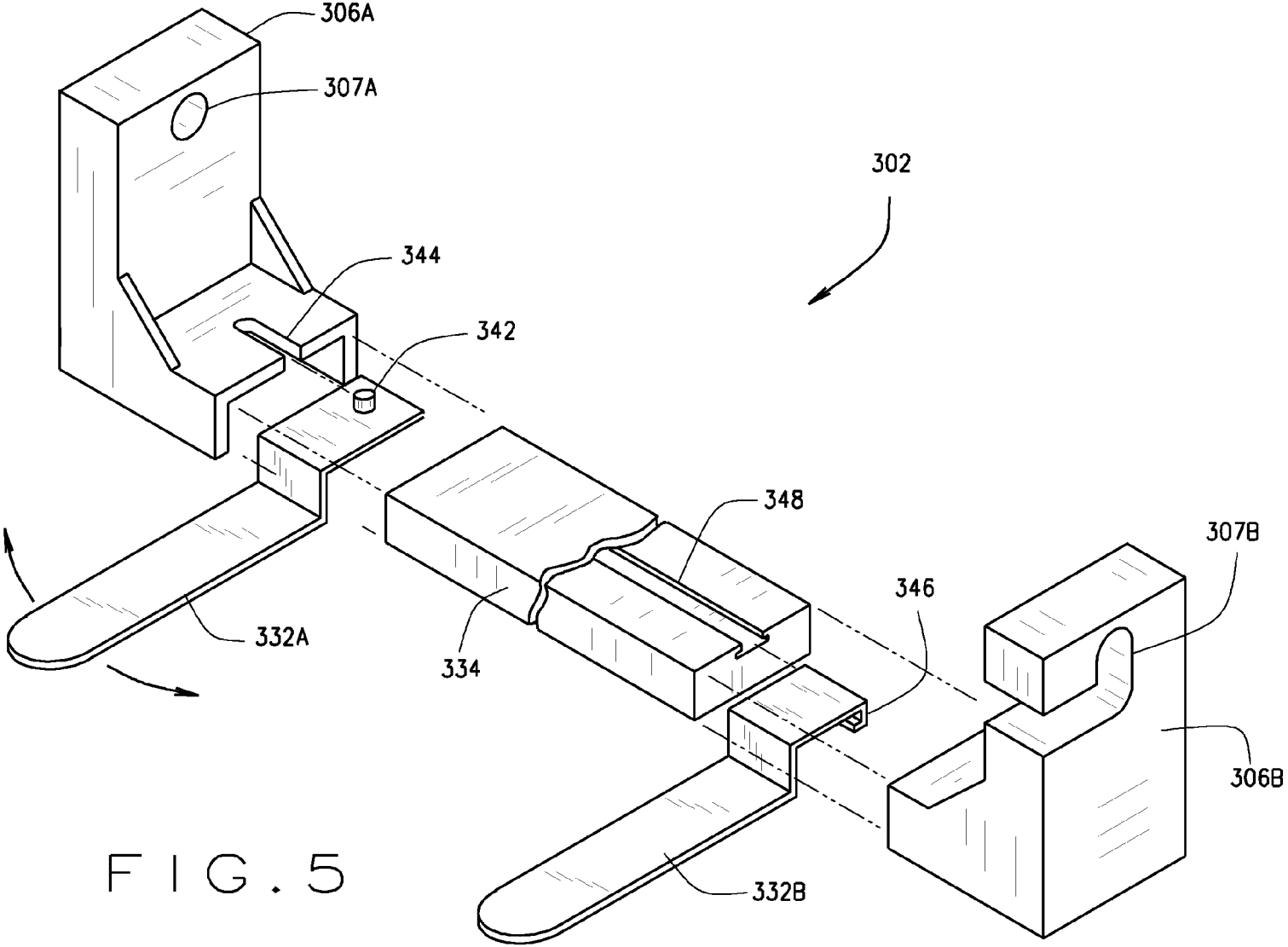
FIG. 5 is an exploded perspective view of a base for a furniture covering device according to an exemplary embodiment.

FIG. 5 illustrates an exemplary base, support, or spool mount 302 that may be used for a furniture covering device, such as with apparatus 100 (FIGS. 1 through 3), 200 (FIG. 4), 400 (FIG. 6), etc. As shown in FIG. 5, the base 302 includes end portions 306 that may be slidably coupled to a middle base portion 334. In other exemplary embodiments, the end portions 306 and middle base portion 334 may be formed (e.g., molded, etc.) so as to have integral or single monolithic component construction. By way of example only, the middle base portion 334 may be formed (e.g., molded, etc.) so as to have a solid interior as shown in FIG. 5. As a further example, the middle base portion 134 may alternatively be formed (e.g., extruded, etc.) so as to be tubular and have a hollow interior, for example, to decrease the weight and material needed for the middle base portion 334.

The various components of the base 302 may be formed from a wide range of materials. The various components of the base 302 may be formed from the same material or a different material as the other components of the base 302. In one exemplary embodiment, the base 302 is formed from wood. In another embodiment, the base 302 may be formed from a moldable plastic material or materials, such as materials that do not rust or are treated to be rust proof (e.g., non-rusting metals or coated metals, etc.). In some embodiments, the base 302 may be formed from a sufficiently heavy enough material such that the weight of the base 302 alone is heavy enough to retain its position without any positioning of foot pads 332 (e.g., FIG. 3, etc.) under the furniture support member.

The end portions 306 may include openings 307A, 307B configured for receiving therein end portions of a spool (e.g., 104, 204, 404, etc.). In this illustrated embodiment, the base 302 includes a thru-hole 307A (e.g., circular hole, etc.) and a generally L-shaped slot 307B. The L-shaped slot 307B includes a lower generally horizontal portion with an open end, and an upper generally vertical portion with a closed end. Accordingly, a spool may be added to the base 302 by positioning one end of the spool into the thru-hole 307A, and then sliding the spool's other end portion into the L-shaped slot 307B via the open end of the L-shaped slot's lower generally horizontal portion. At which point, the thru-hole 107A and closed end of the L-shaped slot's upper generally vertical portion cooperate so as help retain the spool from dislodging from the base 302, such as when a cover is being unwound from the spool. This particular mounting arrangement of the spool to the base 302 may also allow for ready removal and replacement of the spool, such as when an existing spool or the covering material wound thereon is worn out, and/or when a different color of covering material is desired. Alternatively, the base 302 may include differently configured openings or other means for rotatably supporting a spool of covering material and for helping ensure that the spool resists being pulled loose or dislodging from the base 302.

The base 302 is also show with two foot pads 332. The foot pads 332 may be configured to be flush with the ground or floor with the feet of the furniture piece placed directly on them, thus holding down the base 302, for example, while the cover is being pulled out from the spool and/or during high winds.

Also shown in FIG. 5, the foot pad 332A may include an upwardly protruding portion 342 (e.g., pin, etc.) that is configured to be received in a corresponding slot 344 of the end portion 406. The other foot pad 332B may include a downwardly protruding portion 346 configured to be slidably received within a corresponding slot 348 of the middle base portion 334. Accordingly, when the base 302 is assembled, the upwardly protruding portion 342 of the foot pad 332A may be received within the slot 344, and the downwardly protruding portion 346 of the foot pad 332B may be receiving within the slot 348. With this mounting arrangement, the foot pad 332A may thus be rotated (as indicated by the arrows) relative to the base 302, for example, to rotatably adjust the positioning of the foot pad 332A for placement under a foot of a chair, couch, table, etc. This mounting arrangement may also allow the foot pad 332B to be slid relative to the base 302, for example, to slidably adjust the positioning of the foot pad 332B for placement under a foot of a chair, couch, table, etc. In this exemplary manner, the foot pads 332 may thus be adjusted for a variety of feet configurations of a wide range of furniture pieces. This may be advantageous because different types and brands of furniture may have feet in different sizes and with different spacing. Alternatively, the base 302 may include differently configured foot pads (e.g., different shapes, sizes, locations, mounting arrangement, more than two, less than two, etc.). For example, the base 302 may include a different mounting arrangement for the foot pads 332 than that shown in FIG. 5.

Alternatively, other systems and methods may be used to retain the positioning of the base, support, or spool mount 302 relative to the furniture piece, such as adhesives, mechanical fasteners, hook and loop fasteners, magnets, hooks, etc. For example, one exemplary embodiment may include one or more magnets that allow the base to be removably coupled to a particular magnetically responsive portion of a furniture piece (e.g., chair leg, under a table, etc.) formed of a magnetically responsive material, such as a magnetically permeable material (iron, etc.) and/or permanent magnetic material (e.g., neodymium-iron-boron (Nd—Fe—B), etc.).

FIG. 6 illustrates another exemplary embodiment of a furniture covering apparatus 400. As shown, the apparatus 400 includes a base, support, or spool mount 402. The apparatus 400 also includes a spool (only the end portion 405 of which is visible FIG. 6) of covering material 408. The apparatus 400 further includes foot pads 432, a rod 415 at the cover's free end portion 409, end caps 418, a cutout or removed portion 420, a hook 422. Stays, ribbing, or batons 438 are also provided to help keep the cover 408 remain laterally extended or "tented" generally over the edges of the furniture piece. Accordingly, this embodiment of the apparatus 400 and some of its components may be generally similar to the apparatus 100 and the corresponding components thereof previously described and illustrated in FIGS. 1 through 3.

With further reference to FIG. 6, magnets 424 may be attached (e.g., bonded, embedded, etc.) to the cover 408. The magnets 424 may be used for magnetically attaching the cover 408, for example, to a furniture piece having a frame made of steel, wrought iron, other magnetically responsive material (e.g., iron, etc.), and/or permanent magnetic material (e.g., neodymium-iron-boron (Nd—Fe—B), etc.), etc.

By way of example, one or more magnets 424 may be secured in the sleeve or pocket of the cover 408 in which the rod 415 is positioned. As another example, one or more magnets 424 may be positioned within preexisting openings (e.g., slots, holes, etc.) at about the leading edge of the cover 408 (or other suitable location). In such exemplary embodiments, the openings and/or magnets may be configured such that a friction or interference fit may is formed between the magnets 424 and the cover 408, which, in turn, may help reduce manufacturing costs to build the apparatus.

Also shown in FIG. 6, the apparatus 400 further includes a housing or cover member 410 that is positioned generally over the spool and coupled to the base 402. Accordingly, this exemplary embodiment allows the spool of covering material 408 to be stored and housed within the space or enclosed area cooperatively defined by the housing member 410 and the base 402.

The housing member 410 includes an opening or slot 450 through which the cover 408 passes as it is being wound onto or unwound from the spool. The housing member 410 is shown in FIG. 6 with a generally inverted U-shaped or C-shaped profile. Other configurations (e.g., different shapes, etc.) may also be used for the housing member 410 than that shown in FIG. 6.

In this particular embodiment, the end portions 405 of the spool may be rotatably supported within openings 407 of the base's end portions 406. When the housing member 410 is coupled (e.g., via mechanical fasteners, friction or interference fit, etc.), the housing member 410 may help retain the spool's end portions 405 within the openings 407, such as when the cover 408 is being unwound from the spool. Alternative methods may also be employed for rotatably supporting the spool, including differently configured openings in other shapes, sizes, locations, etc. In another exemplary embodiment, a spool may be rotatably supported by brackets that are integral to a base or attached to a base, for example, by screws or other suitable fasteners (e.g., nails, adhesives, etc.). In yet another exemplary embodiment, a spool may be rotatably supported from a base via a thru-hole and L-shaped slot as described above for embodiment 100 shown in FIGS. 1 through 3.

With further reference to FIG. 6, the housing member 410 may be formed from a wide range of materials. In one exemplary embodiment, the housing member 410 may be formed from ABS (Acrylonitrile-butadiene-styrene terpolymer) plastic having a thickness between about three-sixteenths inches and one-fourth inches. In another exemplary embodiment, the housing member 410 may be formed from another moldable plastic material having a thickness of between about three-sixteenths inches and one-fourth inches. The housing member 410 may be provided in any of a wide range of colors. In various exemplary embodiments, the housing member 410 may be provided in a color that substantially matches the color of the furniture piece being covered and/or the color of the support surface or patio material (e.g., deck, brick, stone, etc.). In other embodiments, the housing member 410 may be provided in a color that substantially matches the color of the deck surface supporting the furniture piece. In such embodiments where the color of the housing member 410 matches the deck or other support surface, the cover 408 might be provided in a color that matches the cushions of the furniture piece.

In some alternative exemplary embodiments, either or both of the spool's end portions may extend outwardly beyond the housing end walls so as to create a handle for the user to grasp and thereby facilitate unwinding the cover from the spool and/or winding and retracting the cover back onto the spool. A relatively soft material (e.g., foam, etc.) may be disposed over the handle portions for user comfort. Further, a crank may also be attached or integral with either or both spool end portions to further facilitate winding and unwinding of the cover and/or for adjusting the retraction spring tension in some embodiments.

Alternative embodiments may include one or more foot pads slidably coupled to a rod, which in turn, is coupled to a base, support, or spool mount and/or to a housing member. In such embodiments, the foot pads may be slid (e.g., moved from side to side) along the rod, which thus allows the foot pads to be adjustably aligned and placed under the chair, couch, or table feet. In this exemplary manner, the foot pads may thus be slidably adjusted for a variety of feet configurations of a wide range of furniture pieces having differently configured (e.g., shape, spacing, etc.) feet. Other embodiments may include one or more foot pads removably attachable to a base and/or housing member, such as with magnets, hook and loop fasteners (e.g., Velcro, etc.), combinations thereof, etc. In these embodiments, the foot pads may be removed, repositioned, and then reattached to the base and/or housing member at the particular locations corresponding with the feet of the furniture piece to enable the reattached foot pads to be more properly positioned under the feet of the furniture piece. Alternative embodiments may include one or more foot pads that are tethered so as to allow adjustment to the foot pad positioning relative to the legs of the furniture piece. Other exemplary embodiments may include one or more foot pads coupled to a housing member and/or base in other exemplary manners. Further exemplary embodiments may include one or more foot pads fixedly attached to a base and/or housing member such that the foot pads are not adjustable by sliding or rotation. Various embodiments include one or more foot pads coupled at different locations so as to match up with the feet of a furniture piece that will be covered by the cover.

Some embodiments also include a housing member having one or more lips or overhangs. In such embodiments, the lip may help reduce rain, dew, or other water from entering the housing member. In an exemplary embodiment, the lip may be curved generally downwardly to form a drip edge to facilitate, for example, the flow of liquid (e.g., water from rain or from cleaning the furniture piece, etc.) off the top surface of the housing member. Alternatively, the lip may have a generally hemispherically-shaped profile. In yet another embodiment, the lip may be generally straight and extend generally diagonally in a downwardly direction from the front edge of the housing's top surface.

In other embodiments, the cover may retract in a manner or direction that directs any excess water off the outside of the cover as it spools. For example, the cover may be oriented relative to the spool such that a portion of the cover is disposed generally over the top portion of the spool. In such embodiments, when the cover is unwound and positioned over a furniture piece, the cover may have a generally concave curvature or generally downward slope relative to the ground such that excess water flows or drains off the upper surface of the cover. In some of these embodiments, an opening or slot may be provided in the top of the housing member through which the cover passes as it is being wound onto or unwound from the spool.

Additionally, or alternatively, a device or other means (e.g., rubber materials, brushes, etc.) may be provided, for example, within or outside the housing, for squeezing or squeegeeing excess water off the cover as the cover is being spooled back onto the spool.

Some embodiments include a housing member with a top surface, a back surface, and side surfaces. The housing member may also include a front surface. In addition, the bottom portion of the housing member may be substantially open or completely open to help prevent or reduce the amount of water accumulation within the housing member. Alternative embodiments may include a housing having a solid bottom surface, which, in turn, may include one or more openings therethrough to allow water to drain out from the housing bottom.

Alternative embodiments may include a housing member with side surfaces defined by removable end caps. These removable end caps may facilitate the removal and replacement of a spool. A user may remove the end caps, replace the spool with a different spool, and then reattach the end caps. By way of example, a user may replace a spool when that spool or the covering material wound thereon is worn out, and/or when a different color of covering material is desired.

Some embodiments may include a housing member having one or more surfaces that may include one or more openings (e.g., circular through holes, etc.) therethrough to allow moisture to vent out of the housing member, thereby reducing water and moisture accumulation within the housing.

Some embodiments include a spool having a spindle or rod that is attached to an end portion of the cover. In various embodiments, this rod is substantially solid. Alternatively, other materials and/or other various shapes (e.g., cylindrical shapes, rectangular, triangular, tubular shapes, hollow shapes, etc.) may be used for the spool.

One particular embodiment includes a housing member may be sized dimensionally such that the width W (from front to back) is about three one-half inches and its height H (from top to bottom) is also about three one-half inches (or smaller in some embodiments). Note that all embodiments do not include housing members. The housing member may also be provided in various lengths L (such as forty-eight inches, sixty-four inches, eighty-four inches, etc.) depending on the length of the particular furniture piece being covered, such as a two-person couch, a three-person couch, etc. For a chair, the housing's length L may be less than forty-eight inches. The dimensions provided in this paragraph (as are all dimensions provided herein) are for purposes of illustration only as the particular dimensions of a furniture covering device and components thereof may vary depending on the requirements of the particular application (e.g., particular piece of furniture, etc.) in which the furniture covering device will be used.

Accordingly, various embodiments of the present disclosure provide relatively quick and easy ways to cover outdoor patio furniture to thereby help keep the furniture dry and protect it from weather conditions without having to place specially-fitted and expensive covers over each piece of furniture, without having to bring the cushions out of the weather, and/or without having to store such specially-fitted covers after uncovering the furniture. By using an exemplary embodiment of the present disclosure, a user may avoid the expenses, inconveniences, and time associated with these cumbersome methods.

Aspects of the present disclosure also include furniture pieces that include one or more of the covering apparatus described herein. For example, an exemplary aspect of the present disclosure includes a furniture piece (e.g., outdoor patio chair, etc.) that has attached thereto or built therein a covering apparatus of the present disclosure. As another example, a furniture piece may include a back surface (e.g., back surface of a couch, etc.) to which is attached a covering apparatus of the present disclosure. As a further example, a furniture piece may have two or more legs to which is attached (e.g., fixedly attached, removably attached, etc.) a covering apparatus of the present disclosure.

Various embodiments of the present disclosure may be applied to a wide range of furniture pieces including furniture intended for indoor use and/or outdoor use, such as chairs, tables, recliners, couches, dressers, among others. Accordingly, the specific references to outdoor furniture should not be construed as limiting the scope of the present disclosure to any specific form/type of furniture. Further, various embodiments of the present disclosure may also be applied to outdoor equipment as well.

The dimensions provided herein are for purposes of illustration only as the particular dimensions may vary depending on the particular application (e.g., particular furniture piece, etc.) in which the apparatus will be used.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted.

The description of the present disclosure is merely exemplary in nature and, thus, variations that do not depart from the gist of the present disclosure are intended to be within the scope of the present disclosure. Such variations are not to be regarded as a departure from the spirit and scope of the present disclosure.

What is claimed is:

1. An apparatus for covering a piece of furniture, the apparatus comprising:

a base;

a spool rotatably supported by the base;

a cover coupled to the spool;

an attachment device for removably attaching a portion of the cover to the furniture piece for helping retain the cover's position relative to the furniture piece;

a plurality of foot pads mounted to the base such that each foot pad is adjustably movable relative to the base for selectively positioning each foot pad between a different support member of the furniture piece and a support surface to thereby help retain the position of the base relative to the furniture piece, wherein the plurality of foot pads includes a first foot pad rotatable relative to the base and a second foot pad slidably adjustable relative to the base;

whereby the spool is rotatable in a first rotational direction relative to the spool mount for winding the cover onto the spool, and whereby the spool is rotatable in a second rotational direction opposite that of the first rotational direction for unwinding the cover from the spool to thereby allow the unwound cover to be placed generally over the furniture piece.

2. The apparatus of claim 1, wherein the first and second foot pads each includes a protruding portion engaged within a corresponding slot of the base to thereby allow the corresponding movement of the first an second foot pads relative to the base.

3. The apparatus of claim 1, wherein the attachment device is coupled to the cover at a leading edge portion of the cover, and wherein the attachment device comprises at least one or more of a magnet, a hook, and a rod.

4. The apparatus of claim 1, further comprising a housing member coupled to the base such that at least a portion of the spool is disposed within an enclosure cooperatively defined by the base and the housing member.

5. The apparatus of claim 1, further comprising one or more batons coupled to the cover.

6. The apparatus of claim 1, further comprising means for retaining the position of the apparatus relative to the furniture piece.

7. The apparatus of claim 1, wherein the spool includes first and second end portions respectively received within corresponding first and second openings of the base, to thereby rotatably support the spool by the base.

8. A furniture piece including the apparatus of claim 1.

9. An apparatus for covering a piece of furniture. the apparatus comprising:

a spool mount;

a spool rotatably supported by the spool mount;

a cover coupled to the spool;

a retention device for retaining the position of the apparatus relative to the furniture piece, wherein the retention device comprises a plurality of foot pads mounted to the spool mount such that each foot pad is adjustably movable relative to the spool mount for selectively positioning each foot pad between a different support member of the furniture piece and a support surface to thereby help retain the position of the spool mount relative to the furniture piece, the plurality of foot pads including a foot pad mounted to the spool mount such that the foot pad is slidably adjustable relative to the spool mount for positioning between a support member of the furniture piece and a support surface to thereby help retain the position of the spool mount relative to the furniture piece;

whereby the spool is rotatable in a first rotational direction relative to the spool mount for winding the cover onto the spool; and whereby the spool is rotatable in a second rotational direction opposite that of the first rotational direction for unwinding the cover from the spool to thereby allow the unwound cover to be placed generally over the furniture piece.

10. The apparatus of claim 9, wherein the foot pad comprises a protruding portion slidably engaged within a slot of the spool mount, the sliding engagement of the protruding portion within the slot enabling the sliding movement of the foot pad relative to the spool mount.

11. The apparatus of claim 9, further comprising a housing member coupled to the spool mount such that at least a portion of the spool is disposed within an enclosure cooperatively defined by the base and the housing member.

12. The apparatus of claim 9, further comprising one or more batons coupled to the cover.

13. The apparatus of claim 9, wherein the spool includes first and second end portions respectively received within corresponding first and second openings of the spool mount, to thereby rotatably support the spool by the spool mount.

14. The apparatus of claim 9, further comprising an attachment device for removably attaching a portion of the cover to the furniture piece for helping retain the cover's position relative to the furniture piece.

15. A furniture piece including the apparatus of claim 9.

16. An apparatus for covering a piece of furniture, the apparatus comprising:

a spool mount;

a spool rotatably supported by the spool mount;

a cover coupled to the spool; and a retention device for retaining the position of the apparatus relative to the furniture piece, the retention device comprising a foot pad mounted to the spool mount such that the foot pad is rotatable relative to the spool mount for positioning between a support member of the furniture piece and a support surface to thereby help retain the position of the spool mount relative to the furniture piece, wherein the foot pad comprises a protruding portion engaged within a slot of the base, the engagement of the protruding portion within the slot enabling the rotation of the foot pad relative to the base;

whereby the spool is rotatable in a first rotational direction relative to the spool mount for winding the cover onto the spool; and whereby the spool is rotatable in a second rotational direction opposite that of the first rotational direction for unwinding the cover from the spool to thereby allow the unwound cover to be placed generally over the furniture piece.

* * * * *